United States Patent [19]

Beer et al.

[11] Patent Number: 4,528,084

[45] Date of Patent: Jul. 9, 1985

[54] ELECTRODE WITH ELECTROCATALYTIC SURFACE

[75] Inventors: Henri B. Beer, Heide Kalmthout, Belgium; Jean M. Hinden, Chambesy, Switzerland

[73] Assignee: ELTECH Systems Corporation, Boca Raton, Fla.

[21] Appl. No.: 507,937

[22] Filed: Jun. 23, 1983

Related U.S. Application Data

[63] Continuation of Ser. No. 293,136, Aug. 17, 1981, abandoned.

[30] Foreign Application Priority Data

Aug. 18, 1980 [GB] United Kingdom ..... 8026832
Mar. 4, 1981 [GB] United Kingdom ..... 8106830

[51] Int. Cl.[3] ..... C25B 11/00; C25C 7/02

[52] U.S. Cl. ..... 204/290 F; 502/101; 427/125; 427/126.3; 427/126.5

[58] Field of Search ..... 204/290 F, 291; 452/425.3; 502/101; 427/125, 126.3, 126.5

[56] References Cited

U.S. PATENT DOCUMENTS

| | | | |
|---|---|---|---|
| Re. 28,820 | 5/1976 | Beer | 427/115 X |
| 3,117,023 | 1/1964 | Tirrell | 204/290 F X |
| 3,632,498 | 1/1972 | Beer | 204/290 F |
| 3,915,838 | 10/1975 | Lee | 204/290 F |
| 3,948,751 | 4/1976 | Bianchi et al. | 204/290 F |
| 4,067,783 | 1/1978 | Okinaka et al. | 204/43 G |

*Primary Examiner*—John F. Niebling
*Attorney, Agent, or Firm*—John J. Freer

[57] ABSTRACT

An electrode for use in electrolytic processes comprises a base of film-forming metal such as titanium with an operative outer electrocatalytic surface which is an integral surface film of a compound of the titanium base, usually the oxide, incorporating a platinum-group metal electrocatalyst, preferably iridium, rhodium, palladium and/or ruthenium as metal or oxide. The surface film is formed by the application of a dilute solution of a thermodecomposable iridium, rhodium and/or ruthenium compound containing an agent such as HCl which attacks the titanium base and converts metal from the base into ions which are converted to the compound in a subsequent heating step. The concentrations of this agent and of the thermodecomposable compound and the number of applied layers are such that during heating the electrocatalyst formed from the decomposed compound is incorporated fully in the surface film formed from the base. The base is usually in sheet form, but may also be a powder.

30 Claims, No Drawings

ELECTRODE WITH ELECTROCATALYTIC SURFACE

This is a continuation of application Ser. No. 293,136 filed Aug. 17, 1981 now abandoned.

Technical Field

The invention relates to electrodes for use in electrolytic processes of the type having an electrocatalytic surface on a base of film-forming metal such as titanium, zirconium, tantalum, tungsten, silicon and niobium, and alloys containing one or more of these metals. By "film-forming metal" what is meant is a metal or alloy which has the property that when connected as an anode in the electrolyte in which a coated anode is subsequently to operate, rapidly forms a passivating oxide film which protects the underlying metal from corrosion by the electrolyte, i.e. those metals and alloys which are also frequently referred to as "valve metals", as well as alloys containing a valve metal (e.g. Ti-Ni, Ti-Co, Ti-Fe and Ti-Cu) and which in the same conditions form a nonpassivating anodic surface oxide film.

The invention is particularly but not exclusively concerned with an electrode suitable for use as an anode in oxygen-evolution conditions as for example are encountered in metal electrowinning from sulphate-containing electrolytes.

BACKGROUND ART

Since the proposals to form an electrocatalytic coating material of platinum-group metal oxides (see U.S. Pat. No. 3,711,385) and mixed crystals or solid solutions of co-deposited oxides of platinum-group metals and film-forming metals (see U.S. Pat. No. 3,632,498), dimensionally stable electrodes of this type have revolutionized the chloralkali industry and have become widely used in other applications. Nevertheless, the search for a commercially-viable dimensionally stable electrode for use in oxygen-evolution conditions and which uses only minor amounts of noble metals, is still going on.

Although it has been known from U.S. Pat. No. 3,711,385 that the electrocatalytic coating of a platinum-group metal oxide could be made quite thin (said patent claiming a minimum thickness of 0.054 micron), in practice it has been found that to achieve any acceptable lifetime, or in some instances for the electrode to work at all, a somewhat thicker coating was necessary. Hence, usually ten to twenty thin coatings of a suitable paint solution are applied to the film-forming metal base and heated each time to give an electrocatalytic coating formed from the decomposed components of the paint containing about 5 to 20 grams by metal of the platinum-group metal oxide per square meter of the electrode area (i.e. its projected, geometrical surface area).

Many attempts have been made to economize on the precious metal content of these coatings, usually by partly replacing the platinum-group metal oxide by a compatible non-precious metal oxide such as tin dioxide (see for example U.S. Pat. No. 3,776,834) or tin and antimony oxides (see for example U.S. Pat. No. 3,875,043).

At present, probably the best electrode for oxygen-evolution is that described in UK Patent Specification No. 1 399 576, having a coating containing a mixed crystal of tantalum oxide and iridium oxide. However, known electrodes of this type contain at least about 7.5 $g/m^2$ of iridium so that despite their excellent performance in terms of over-voltage and lifetime, the high cost of iridium makes these electrodes less attractive and in order to be competitive with cheaper anodes they must be operated at a relatively high anodic current density which necessitates various expedients in the cell design. Consequently, anodes made of solid lead, lead alloys, cobalt-silicon alloys and so forth are still used in many electrowinning plants despite the known disadvantage of such materials.

Another type of electrode proposed in UK Patent Specification No. 1 463 553 has a base which consists entirely of or at least at its surface of an alloy of a film-forming metal and an activating metal for instance a platinum-group metal, whose surface is oxidized during use or is preactivated by an oxidizing treatment to form in the outer part of the alloy a surface oxide layer to a depth of 1 to 30 microns. Such alloys have shown promise for electrowinning but are quite difficult to prepare by sintering or in another manner and are quite expensive because of the quantity of platinum-group metal in the alloy. Also, the pre-activation methods are difficult to control to obtain an improvement in the electrode performance.

There have also been suggestions for coating oxygen-evolving anodes with non-precious metal oxides such as manganese dioxide, usually in quite large quantities, and possibly with some additives: see for example, U.S. Pat. No. 4,072,586. The $MnO_2$ coating is sometimes deposited over an intermediate conductive layer of, for example, tin and antimony oxides (U.S. Pat. No. 4,028,215) or on a titanium surface pretreated with a small quantity of $RuO_x$ (see Japanese published patent application No. 11753/80, Application No. 156740/76 and Electrochimica Acta, 1978, Vol. 23, pp. 331–335). Again, some of these $MnO_2$-coated electrodes have shown promise for electrowinning processes but have not yet met with commercial success.

The scientific literature has manufacturing of the passive surface films formed on film-forming metals, as well as such films doped with a small quantity of platinum metal or oxide, by cathodic deposition of platinum metal onto a cleaned titanium base, followed by anodisation. (See papers "Electronic properties of doped passive layers on titanium electrodes" by U. Stimmung and J. W. Schultze and "Investigations of doped passive layers on titanium electrodes by electron spectroscopy" by D. Hofman and U. Stimmung, presented at the ISE Budapest Meeting, Aug. 28 to Sept. 2, 1978). However, the results indicate that such $PtO_2$-doped films are almost insulating and the thus-produced platinum dioxide-doped films have a conductivity approaching that of metallic platinum only when excess platinum is present.

It has also been suggested in W. German Offenlegungsschrift No. 26 52 152 to form an electrode by anodically growing a film of titanium oxide on a titanium strip in an electrolyte containing a solution of platinum metal so as to occlude particles of platinum in the titanium oxide film. However, this procedure has not led to the production of useful electrodes.

One situation in which known electrodes have been particularly subject to failure and/or poor performance is the electrolysis of manganese-contaminated electrolytes where deposits of manganese or manganese oxide on the anode have led to "poisoning" of the electrocatalyst and rise of the cell potential. Other critical situations are where the cell is subject to shutdown, or current reversal which may lead to dramatic failure of coatings which, in other respects, has performed quite well.

An object of the invention is therefore to provide a film-forming metal electrode which is made electrocatalytic on its surface in an inexpensive manner, has a low oxygen overvoltage, is able to withstand cell shutdown, and even current reversal and, in addition, has an excellent resistance to the effects of manganese/manganese dioxide deposition.

DISCLOSURE OF THE INVENTION

The invention, as claimed, concerns a novel electrode for use in electrolytic processes comprising a base of film-forming metal with an operative electrocatalytic outer surface formed as an integral surface film of either an oxide or another compound of the film-forming metal base incorporating therein a platinum-group metal or compound thereof as electrocatalyst.

According to the invention the manufacture of such an electrode is simplified and its performance is enhanced by forming said electrocatalytic outer surface by applying to the surface of the film-forming metal base at least one layer of a solution of at least one thermodecomposable compound of a platinum-group metal, drying and heating each applied layer to decompose said compound(s) in a similar manner to methods know per se for the formation of platinum-group metal and platinum-group metal oxide coatings, wherein said solution contains an agent which attacks the film-forming metal base and converts metal from the base into ions which are converted into a compound of the film-forming metal during the heating step, the concentration of said agent and of the platinum-group metal compound(s) in the solution and the number of applied layers being such that during the heating of each layer including the last one the electrocatalyst formed from the decomposed compound is incorporated fully in the surface film of film-forming metal compound formed from the base.

In contrast to known electrode coatings produced by thermodecomposition of successively applied layers of a suitable paint, the platinum-group metal electrocatalyst is contained wholly within the surface film of the base whereas with the known electrodes a coating consisting of several separate layers of the electrocatalytic material is built up over and on top of the film-forming metal base with its very thin integral surface oxide film.

The nature of the film-forming metal compound of the integral surface film will naturally depend on the atmosphere used for the heating step. The heating may conveniently be carried out in air in which case the film consists of film-forming metal oxide incorporating the platinum-group metal and/or oxide thereof, possibly in the form of a mixed oxide. In a similar manner, heating in hydrogen at a temperature of from about 250° to about 500° C., typically about 400° C. leads to formation of a film-forming metal hydride film without subjecting the base to hydrogen embrittlement. Films of film-forming metal boride, nitride and carbide can be formed by heating in boron,nitrogen or carbon-containing atmospheres. For example, nitrides can be formed by heating in a dry atmosphere of ammonium chloride at temperatures from about 350° C. to 450° C. or in dry ammonia at temperatures from about 400° C. to 900° C. In ammonia, nitride formation in the lower temperature range of about 400°-600° C. is particularly favoured when using alloy bases such as titanium containing about 0.5% molybdenum or about 6% of chromium or vanadium. Carbides can be formed by heating in some organic atmospheres or in carbon monoxide at about 700° C.-1000° C. or in an atmosphere containing very finely powdered coal. It is also possible to form mixed or complex compounds with the film-forming metal, e.g. titanium oxychloride. When a non-oxidizing atmosphere is used, the platinum-group metal compound will generally be converted to the metal, integrated in the film-forming metal compound, possibly as an intermetallic compound, between the platinum-group and film-forming metals.

With electrodes according to the invention, the surface film formed from the film-forming metal base incorporates one or more platinum-group metal electrocatalysts, preferably iridium, rhodium, palladium and/or ruthenium, as metal or as a compound (usually the oxide or a partially oxidized compound which may be incorporated in the surface film as a mixed film-forming metal/platinum-group metal oxide when the heating is carried out in air or in an oxidizing atmosphere), possibly in an amount of up to only about 0.5 $g/m^2$ of the metal per projected surface area of the electrode base, although greater amounts can be incorporated.

The method of manufacture involves the application of a very dilute acidic paint, i.e. one which contains a small quantity of a thermodecomposable platinum-group metal compound that during decomposition and simultaneous formation of the surface film of film-forming metal compound will be fully absorbed by this surface film, this dilute paint containing generally about 1-15 g/l of iridium, rhodium, palladium and/or ruthenium (as metal).

The paint used will typically include a solvent such as isopropyl alcohol or alternatively an aqueous solvent, an acid (notably HCl, HBr, HI or HF) or another agent (e.g. NaF) which attacks the film-forming metal and converts metal from the base into ions which are converted into the compound of the film-forming metal during the subsequent heat treatment, and one or more thermodecomposable salts of iridium, rhodium, palladium and/or ruthenium. Usually this solution will be at least five times more dilute and preferably about 10 or more times as dilute (in terms of its precious metal content) than a corresponding paint solution heretofore used for the production of "traditional" electrocatalytic oxide coatings; this means that the quantity of platinum-group metal such as rhodium and/or ruthenium will be reduced, e.g. to 1/5 or 1/10 or even 1/100 for approximately the same quantity of solvent and acid.

The action of the acid or other agent which attacks or corrodes the film-forming metal and promotes the formation of the surface film during the subsequent heat treatment is very important; without a sufficient quantity of a suitable agent producing this effect, formation of the surface oxide film of the film-forming metal would be substantially hindered or inhibited.

It has been observed that by, applying one coat of a given solvent/acid mixture to a film-forming metal base subjected previously to the usual cleaning and etching treatments and then heating in air after drying to drive off the solvent, a given quantity of film-forming metal oxide will be produced. This procedure can be repeated a number of times (usually four to ten times for 4 ml HCl in 60 ml isopropyl alcohol applied to a titanium base and heated to 500° C. in air for ten minutes) before the growth of film-forming metal oxide during successive treatments becomes inhibited. The first layer of the integral surface oxide film formed will be relatively porous. This allows the subsequently-applied coat of the acid paint to penetrate this porous first layer during the drying phase so that the acid attacks the underlying film-forming metal. Ions of the film-forming metal are thus provided by the base for conversion to oxide during the subsequent heating, this oxide being partly formed within the pores of the first layer. The porosity of the resulting oxide film is thus reduced after each coating cycle until no more film-forming metal from the base can be converted to oxide. An extremely stable, relatively compact and impermeable film of film-forming metal oxide can thus be formed by the application of a limited number of coats of acid paint followed by drying and heating. Similar considerations apply to the formation of carbide, nitride, boride and hydride films using appropriate atmospheres.

To prepare electrodes according to the invention, each applied coat of paint includes such a small quantity of the platinum-group metal compound that the electrocatalyst formed by thermodecomposition becomes fully incorporated in the integral surface film that is formed each time. Usually, each applied coat of the paint will contain at most about 0.2 $g/m^2$ of iridium, rhodium, palladium, and/or ruthenium per projected surface area of the base, usually far less. Additionally, the application of further layers of the dilute paint is stopped after the number of coats beyond which growth of the surface film on the film-forming metal ceases or is inhibited. Thus, the optimum quantity of electrocatalytic agent in the paint and the optimum number of coats to be applied can be determined quite easily for any particular substrate, solvent/acid and electrocatalytic material. Typically, the agent attacking the film-forming metal base will be hydrochloric acid, and the molar ratio of the amount of agent to the iridium, rhodium, palladium and/or ruthenium compound in the paint solution will be from 1:1 to 100:1, preferably between 3:1 and 30:1. In many instances, two to ten layers of the very dilute paint will be applied, each followed by drying and heating from about 400° to 600° C. for about 5 to 15 minutes, with the possible exception of the final layer which may be heated for a longer period—possibly several hours or days at 450°–600° C. in air or in a reducing atmosphere (e.g. ammonia/hydrogen).

When viewed by the naked eye or under a microscope, electrodes produced in this manner on an etched or non-etched titanium base heated in air usually retain the same range of distinctive appearances as titanium oxide films prepared in the same manner which do not contain the platinum-group metal electrocatalyst, typically a bright blue, yellow and/or violet "interference" film colour. Thus, instead of applying a conventional platinum-group metal oxide coating or mixed crystals of codeposited oxides over the base and over the very thin oxide film on its surface to produce a coating with a distinctive "mud-cracked" appearance, the invention provides what could more aptly be described as a surface treatment of the film-forming metal base since the electrocatalytic material is contained in the integral oxide film formed on the base and does not form a distinct coating as such. When a titanium base is heated in air, the surface oxide film is found to be predominantly rutile titanium dioxide. Presumably, the formation of rutile e.g. at about 400°–500° C. is catalyzed by the platinum-group metal in the dilute paint.

Compared to the aforesaid alloy electrodes of UK Patent Specification No. 1 463 553, the electrodes of the invention are different in that not only will the treated surface usually contain many times less platinum-group metal (e.g. iridium, rhodium, palladium and/or ruthenium) than the corresponding pre-activated surface coating, but also the precious metal electrocatalyst will be incorporated only in the surface film formed on the film-forming metal. The electrodes are thus less expensive and the manufacturing process is simpler and more reproducible. However, it will be appreciated that alloy electrodes such as Ti-Ni, Ti-Co, Ti-Cu and Ti-Fe taught by this UK Patent Specification can, to great advantage, be surface-activated in accordance with the present invention.

Whereas for conventional coatings it has been found advantageous to codeposit a platinum-group metal oxide and a film-forming metal oxide from a paint solution containing the appropriate thermodecomposable components each, the dilute acidic paint solution used to prepare electrodes according to the invention preferably only includes a thermodecomposable platinum-group metal compound (i.e. of iridium, rhodium, ruthenium, platinum, palladium and/or osmium), since the film-forming metal oxide component is provided by the surface film grown up from base, when the heating is carried out in air. Often, ruthenium, platinum, palladium and osmium compounds are only used in combination with iridium and/or rhodium compounds, but they can also be used alone. However, the dilute paint may also include small amounts of other components such as gold, silver, tin, chromium, cobalt, antimony, molybdenum, iron, nickel, manganese, tungsten, vanadium, titanium, tantalum, zirconium, niobium, bismuth, lanthanum, tellurium, phosphorous, boron, beryllium, sodium, lithium, calcium, strontium, lead and copper compounds and mixtures thereof. If any small quantity of a film-forming metal compound is used it will preferably be a different metal to the film-forming metal substrate so as to contribute to doping of the surface film. When such additives are included in the dilute paint composition, they will of course be in an amount compatible with the small amount of the main platinum-group metal electrocatalyst, so that all of the main electrocatalyst and additive is incorporated in the surface film of film-forming metal compound. In any event, the total amount of iridium, rhodium, palladium and/or ruthenium and other metals is usually below 2 $g/m^2$ (calculated per projected surface area of the electrode base when the base is in sheet or similar form) and may advantageously be well below 1 $g/m^2$, possibly even lower than 0.5 $g/m^2$. These platinum-group metal compounds and other metal compounds may be thermodecomposable to form the metal or the oxide, but in neither case is it necessary to proceed to full decomposition. For example, coatings prepared from partially decomposed iridium chloride containing up to about 5% by weight of the original chlorine, have shown excellent properties.

The electrode base may be a sheet of any film-forming metal, titanium being preferred for cost reasons. Rods, tubes and expanded meshes of titanium or other film-forming metals may likewise be surface treated by the method of the invention, as can wires and elastically-compressible mats made up of helicoidally wound wires or knitted wires of the film-forming metal. Titanium or other film-forming metal clad on a conducting core can also be used. It is also possible to surface treat porous sintered titanium with the dilute paint solutions in the same manner. Also, as explained further on, the electrode base may be in particulate form, i.e. as a fragmentary solid of any desired shape e.g. in the form of powders, granules, pellets, fibres and flakes of any suitable size, including titanium sponge.

For most applications, the base will be etched prior to the surface treatment, but in some instances the base may simply be cleaned, and this gives a very smooth electrode surface.

Electrodes according to the invention containing an iridium, palladium and/or rhodium-based electrocatalyst have a low oxygen-evolution potential and have performed extremely well as oxygen-evolving anodes, e.g. in the electrowinning of heavy metals such as cobalt in manganese-containing electrolytes. They have also performed very well as anodes for the electrolytic production of manganese dioxide. The electrodes also perform well in processes involving reversal of the electrode polarity. After cathodic polarization for ½ hour, some electrodes originally with a bright blue colour have changed to a grey appearance, but continued to operate well both as cathode and anode. This change of colour may be attributed to a reduction to the precious metal, or to a change in crystal structure of composition of the surface film.

Tested sheet-type electrodes containing as little as 0.05 to 0.3 $g/m^2$ (as metal) of iridium and/or rhodium oxide/chloride in their surface film have shown no signs of deterioration in oxygen-evolution lifetime tests running for several months. Considering the extremely small quantity of precious metal, this performance is quite remarkable. Excellent results have also been obtained with compounds of (a) iridium and/or rhodium and (b) ruthenium in a weight ratio (a):(b) as metal of from 4:1 to 1:4, preferably about 2:1.

Generally speaking, the electrodes of the invention are useful in the electrolysis of electrolytes which contain materials that deposit or tend to deposit on the surface of at least one of the electrodes and are removed from or are prevented from depositing on said surface. This includes processes in which the anodically/cathodically deposited material is removed as a useful product; electrolytic processes in contaminated electrolytes in which the deposits tend to reduce process efficiency and hence are removed or inhibited; and processes in which unwanted organic and other materials which deposit on immersed titanium and similar metallic structures are electrolytically removed from the structures or prevented from depositing by connecting the structures as electrodes and passing current continuously or intermittently.

The electrodes according to the invention are thus particularly advantageous in the electrolysis of manganese-containing electrolytes in which a manganous deposit is deposited on and removed from an anode surface formed by the surface film. A specific example of this is the production of electrolytic manganese dioxide (EMD) wherein an adherent layer of EMD is built up on the anode surface film and removed from the surface film for further processing. Advantageously, the EMD deposit is removed from the surface film by cathodic polarization possibly assisted by impact or vibration according to the teaching of U.S. Pat. No. 4,170,527. Preferably, a set of electrodes are used as anodes and cathodes with the surface films forming the anode and cathode surfaces, and the current is periodically reversed to remove the EMD deposits whereby each surface film alternately operates as anode and cathode. Alternatively, the EMD deposit may be removed mechanically, for example by the more conventional technique of applying an impact, it being understood that this will be made less arduous by employing a very smooth activated surface anode film. Advantageously, the EMD deposit can be deposited on a thin flexible sheet of e.g. titanium surface-treated according to the invention, and the deposit removed by flexing the sheet.

Another example of use of the electrodes is when the electrolyte contains traces of manganese as an impurity, and the manganous deposit is periodically removed from the anode surface film. For example, in the production of hypochlorite by the electrolysis of manganese-contaminated brine, the manganous deposit can be periodically removed from the activated surface film by current reversal. The advantages of using an activated surface film instead of an applied "thick" electrocatalytic coating as taught in U.S. Pat. No. 4,087,337 are that current reversal can be carried out at a relatively high current density of, say, 500 $A/m^2$ without damaging the activated surface film, and the smooth active surface film provides less anchorage of the deposit than the conventional "thick" porous coating. Therefore, removal of the deposit is facilitated and the film does not tend to become poisoned by encrustation with the deposit.

Yet another example of use of the electrodes is the electrowinning of a metal, e.g. cobalt, from an electrolyte containing e.g. cobalt and manganese, wherein the cobalt (or other metal such as zinc, copper and lead) is deposited on a cathode and manganese dioxide is deposited on and removed from the activated anode surface film. It has been observed that with increasing anodic current density the faradaic efficiency for the $MnO_2$ deposition drops and the deposit becomes less adherent. Therefore, preferably this method is operated at an anodic current density of 500 to 1000 $A/m^2$ so that a substantial part of the manganese dioxide deposit does not adhere to the anode surface film. Preferably the anodic current density will not be maintained much higher than 1000 $A/m^2$ as the activated surface films with a very low catalyst loading do not remain active for a long period at a very high current density, e.g. 2000 $A/m^2$ or more. In this process, most of the manganese deposit does not adhere and drops off the anode surface film, and the adherent manganese dioxide deposit is removed from time to time by current reversal or mechanically, e.g. by brushing after removing the anode from the electrolyte and drying it.

In another application of the electrodes according to the invention, the electrolyte contains hardness impurities which are deposited on and removed from a cathode surface formed by said surface film. Typical hardness impurities encountered in various electrolytes are calcium and magnesium. Such cathodic deposits may be removed by anodic polarization, possible by current reversal between the anode and the cathode, especially when the anode also has an activated surface film according to the invention which makes it resistant to current reversal. However, for titanium anodes with standard "thick" coatings applied in the conventional manner over and on top of the titanium substrate with its thin passive oxide film, it is possible to use the arrangement taught in U.S. Pat. No. 4,088,550 where several cathodes are placed facing an anode and are sequentially and selectively made anodic to remove the deposit whereas the other cathodes and the principal anode remain in normal operation. An advantage of using electrodes according to this invention as cathodes in said arrangement is that much higher anodic current density can be applied to them during deposit removal without fear of developing a passivating film or dissolving the electrode. Typical examples of this application are swimming pool chlorinators, on-site hypochlorite generators, sewage treatment units, electroflotation, electrodialysis and electroflocculation.

The electrodes according to the invention can also be used for the recovery of anodically-depositing metal oxides other than manganese dioxide, such as the recovery of uranium dioxide ($UO_2$) from a dilute electrolyte containing traces of uranium, such as seawater. When the seawater also contains manganese, the $UO_2$ and $MnO_2$ will codeposit and be recovered together. $UO_2$ deposition advantageously takes place in oxygen evolving conditions to avoid the dissolution of $UO_2$ by chlorine, and anodic surface films acitvated with small quantities of rhodium and/or iridium and optionally ruthenium or platinum as metals or compounds are excellent for this purpose.

Another application of the electrodes of the invention is the protection of an immersed structure of film-forming metal from surface deposits of unwanted organic and other materials by providng the structure with the electrically conductive and electrocatalytic surface film, connecting the structure as an electrode and passing current continuously or intermittently. The structure may for example be a titanium heat exchanger immersed in salt water where biofouling is a major problem or a titanium evaporator immersed in saline or non-saline water where hardness deposits cause problems. The structure is firstly provided with the activated surface film by application of a dilute paint and heating e.g. in air as previously described, and then connected as an anode and current is supplied to generate chlorine and/or oxygen on the surface film. Typically, only a very low current density of the order of 10 $A/m^2$ is found to achieve an adequate protective effect. This current may be supplied continuously or intermittently. To avoid the build up of scale on the cathodic surfaces used, the polarity of the structure and its surface film may be reversed from time to time. For some structural configurations such as coaxial titanium pipes, it is advantageous to use different parts of the structure each with an activated surface film as anode and cathode and to periodically reverse the current. In other instances, auxiliary cathodes will be used and these may advantageously have a film-forming metal base with an activated surface film.

Yet another application of the electrodes of the invention is in an impressed-current cathodic protection system for protecting structures such as ships hulls, bridges, off-shore oil drilling platforms, jetties and so on from corrosion by supplying current using an anode having a film-forming metal base with the activated surface film as its anodic surface. One advantage over platinum-coated titanium anodes heretofore used for this purpose is that large anodic surfaces can be provided with the activated surface film at a very moderate cost and this enables the effective protection of large structures of complex shape. Moreover, the activated surface film is very resistant to mechanical damage because the surface film does not chip or peel off as platinum coatings do when subjected to extreme wear and tear. Furthermore, it is well known that titanium is not considered adequate for all cathodic protection environments but must sometimes be replaced by the more expensive tantalum which has a higher breakdown potential; using an activated surface film over a large titanium surface is an effective way of preventing the breakdown voltage being reached and therefore enables the use of titanium as a cathodic protection anode in environments where previously it was considered unsafe.

In addition to the various applications described above, the described electrodes are useful in a variety of processes particularly at "low" current densities not exceeding about 1 $kA/m^2$ where low-cost electrodes (compared to conventional coated electrodes having several grams of precious metal/$m^2$) are attractive and where the special properties of the smooth or etched surface-treated film are advantageous. For example, the electrodes are excellently suitable for operation with a.c., for example for breaking up emulsions in drilling. They can also be used as reversible electrodes in electroflotation, e.g. for separating oil and water. In some processes, the electrodes will also be competitive as cathodes because the activated surface films protect the film-forming substrate from hydrogen embrittlement, and they can also be used as bipolar electrodes. Finally, the electrodes can be repeatedly flexed without damage to the surface film, in contrast to conventional electrodes with a separate outer coating where stresses at the coating/base interface develop and cause damage to the coating when the electrode is flexed. The electrodes are therefore useful in processes for the removal of adherent surface deposits by flexing of an electrode.

Another aspect of the invention concerns electrodes for use in electrolytic processes comprising particles of a film-forming metal each having an integral electrocatalytic and electroconductive surface film of a compound of the film-forming metal, usually the oxide, containing a platinum-group metal electrocatalyst. Such an integral surface film is formed by applying to the film-forming metal particles at least one layer of a solution of at least one thermodecomposable compound of a platinum-group metal, drying and heating each applied layer to decompose the compound(s), wherein the applied solution contains an agent which attacks the film-forming metal surface of the particles and converts metal from the surface into ions which are converted into oxide (or another compound) of the film-forming metal during the heating step, the concentration of said agent and of the platinum-group metal compound(s) in the solution and the number of applied layers being such that during the heating of each layer including the last one the decomposed electrocatalyst is incorporated fully in the surface film formed on the particles. In other words, the film-forming metal particles are surface activated as explained above in relation to electrodes having a base in sheet or other nonfragmentary form. Conveniently, the solution will be applied by immersion of the particles in the solution instead of by painting. The solution composition and the heating conditions will be similar to those described above for the electrodes with a sheet-type base. However, for the drying step it is preferred with the particles to use a two-stage drying for example 15 minutes at 50°–70° C., 140° C. and 180° C. in order to ensure that all of the solvent is driven off. When large quantities of powder are treated, the drying step will generally be prolonged.

Also, it has been found that a single application of the paint solution gives excellent results with the particulate film-forming metal, and the building up of the film by the application of successive layers is not recommended.

The surface-activated film-forming metal particles can be incorporated in various types of electrodes including electrodes in which the particles are associated with a current feeder, such as fluidized particulate bed electrodes and circulating slurry electrodes, and electrodes comprising a conductive support such as a sheet, tube, rod or mesh on which the surface-activated particles are fixed. The surface-activated powder may be applied to the conductive support by mechanical means such as hammering or the application of pressure using pressure rollers (possibly with the application of heat, depending on the material of the support), by plasma-spraying, or using a binder such as PTFE or $TiO_2$. The activated particles can also be codeposited on the conductive support as occlusions in a metal or metal oxide covering layer, for example using the electroless or electroplating methods described in West German Offenlegungsschrift No. 26 52 152.

The surface-activated particles may for example be embedded in the surface of a body of lead or a lead alloy such as Pb-Ag, Pb-Ca or Pb-Sb, for example by hammering, hot or cold pressing or by plasma-spraying, to form an anode suitable for the electrowinning of metals from acidic solution, and which will advantageously replace the conventional lead or lead alloy anodes used in metal electrowinning. It has been found that the activated particles reduce the oxygen overvoltage of the anodes to such a degree that the underlying lead or lead alloy base functions as a conductive support which is electrochemically inactive at the reduced anode potential. The lead or lead alloy base is thus effectively protected by the activated particles so that contamination of the electrolyte and the cathodic deposit are significantly reduced. Also, if dendrite formations on the cathode produce short-circuits with the anode thereby removing areas of the activated powder and burning holes in the anode base material, this does not have serious consequences because the undamaged coated part of the anode will continue to operate at the reduced half-cell potential and the damaged uncovered part of the base will not conduct current into the electrolyte and hence will not undergo notable corrosion.

Various film-forming metals in particulate form, preferably with a size corresponding to 20–200 mesh ASTM, can be surface-activated as described for incorporation into electrodes. Powdered film-forming metals, in particular titanium sponge powder and zirconium powder, are considerably less expensive than the massive metals and therefore the resulting electrodes are relatively inexpensive especially as the special surface-activation procedure is achieved with very small quantities of the platinum-group metal electrocatalysts.

BEST MODES FOR CARRYING OUT THE INVENTION

This invention will be further illustrated in the following examples:

EXAMPLE I

Coupons measuring 7.5×2 cm of titanium available under the trade name "Contimet 30" were degreased and etched for ½ hour in a 10% aqueous solution of oxalic acid at 85° to 95° C. A paint solution consisting of 6 ml n-propanol, 0.4 ml HCl (concentrated) and 0.1 g of iridium and/or rhodium chloride was then applied by brush to both sides of the coupons in thin coatings. The coupons were then dried and heated in air to 500° C. for 10 minutes after each of the first three coatings and for 30 minutes after the final coating.

Some further coupons were surface treated by the same procedure except that the etching pretreatment was replaced by a cleaning treatment consisting of electrochemical degreasing in a solution of waterglass and 10% $Na_2CO_3$ followed by ultrasonic cleaning in a 1:1 weight mixture of acetone and $CCl_4$. Pairs of these cleaned and etched coupons were tested as electrodes in 5% sulphuric acid at room temperature. The electrodes were spaced apart by approximately 2 cm. Current was supplied at 500 A/m$^2$ and the polarity of the electrodes was reversed every ½ hour. The initial cell voltage was measured, and the time taken to reach a cell voltage of 3 V is indicated in Table I as the lifetime.

TABLE 1

| Coating Material Treatment | $RhCl_3$ | | $IrCl_3$ | | $RhCl_3$—$IrCl_3$ | |
|---|---|---|---|---|---|---|
| | Cleaned | Etched | Cleaned | Etched | Cleaned | Etched |
| Initial Cell Voltage (V) | 2.19 | 2.10 | 2.14 | 2.37 | 2.14 | 2.25 |
| Lifetime (hours) | 250 | 200 | 50 | 720 | not measured | 815 |

One etched sample surface treated with a paint containing $IrCl_3$ was still running under current reversal after 2 months. Without current reversal, the anodes work for many months with no apparent deterioration. It was observed during this current-reverse test that the electrodes which initially had a bright blue colour became dull metallic grey when connected as cathode for ½ hour. The electrodes maintained this grey appearance even after strong heat treatments.

EXAMPLE II

The "cleaned" electrodes of Example I were tested for $MnO_2$ production in a 2M manganous sulphate solution containing ¼M $H_2SO_4$ at 90°–95° C. and with a current density of 250 A/m$^2$. The electrodes had a very smooth treated surface on which $MnO_2$ deposited when the electrodes were connected as anode. However, the $MnO_2$ deposit was easily removed by reversing the polarity after 30 minutes or 1 hour. Best results for $MnO_2$ production were obtained with "cleaned" electrodes treated with the paint solution of Example I containing 0.05 g of $IrCl_3.H_2O$ and 0.05 g $RuCl_3.H_2O$ and heated as in Example I but in a reducing atmosphere ($NH_3$/propane mixture) with a final heat treatment for 72 hours at 500° C. in air. Excellent results were also obtained when the paint contained 0.1 g of palladium, rhodium, iridium or ruthenium chloride alone, or in various mixtures.

EXAMPLE III

Titanium coupons were (a) degreased, rinsed in water and dried, and (b) etched, then surface treated as in Example I with paint solutions containing 0.1 g of (a) rhodium chloride and (b) iridium chloride. The quantity of paint applied to each coupon was measured by weighing, and the amount of catalyst in the surface treated electrodes after application of four coatings was calculated to be (a) 0.2 g/m$^2$ of Rh, as metal and (b) 0.33

$g/m^2$ of Ir, as metal. These electrodes were tested as anodes for cobalt electrowinning in an electrolyte containing 31.2 g/l of Co and 1.2 g/l of Mn at 60° C., using a stainless steel cathode.

For anode (a), the initial cell potential at 200 $A/m^2$ was 2.5 V compared with an initial cell potential of 5.4 V for a standard "Luilu" anode in the same conditions. The cobalt yield at the cathode was very close to 100% by maintaining the pH above 1.5. The $MnO_2$ yield deposited on the anode depended on the anodic current density, and was highest at current densities below 300 $A/m^2$. The $MnO_2$ deposit adhered loosely and could easily be removed by reversal of polarity or by scraping after removing and drying the anode.

With anode (b), the initial cell voltage was less than 3 V at 300 $A/m^2$ (for a corresponding coating applied to a cleaned but non-etched coupon, the initial cell voltage was 50 mV higher). Electrolysis was continued for 8 hours, then the anode was removed, dried in air at room temperature and the $MnO_2$ deposit brushed off, the last traces being removed in hot 10% sulphuric/oxalic acid. The electrolysis procedure was repeated ten times, and there was no change in the oxygen over-potential. The cathodic efficiency was close to 100% Co with the pH maintained at a value $>1.5$ by adding sodium carbonate.

With the cleaned non-etched coupons, the treated surfaces are so smooth that the $MnO_2$ deposit adheres very poorly and may partly peel off during electrolysis. At relatively high current density (e.g. about 1000 $A/m^2$), less $MnO_2$ deposited, and practically all of this deposit fell off automatically thus providing a practically continuous process since frequent removal and stripping of the anode was not necessary. The faradaic efficiency for Mn deposition on the anode was in fact observed to drop from 10% to 5% and then to 2–3% by increasing the current density from 300 $A/m^2$ to 600 $A/m^2$ and 1000 $A/m^2$.

EXAMPLE IV

Example I was repeated with paints containing $IrCl_3$ and $RhCl_3$, but varying the heating temperature from 400° C. to 600° C. The electrodes were then subjected to lifetime tests in a current reversal process as in Example II. For the electrodes surface treated with $IrCl_3$, the optimum lifetime under current reversal conditions (1 month) was obtained with heating at 500° C.; for those treated with $RhCl_3$, the optimum lifetime (10 days) was obtained with heating at 550° C. This lifetime can be greatly increased by increasing the heating time after the last treatment. Of course, the lifetime when the electrode is used only as anode or as cathode, without current reversal, is much longer; electrodes containing 0.3 $g/m^2$ of Ir and/or Rh (as metal) have been operating as anodes in 150 g/l sulphuric acid for 11 months without any deterioration.

EXAMPLE V

Example I was repeated with a paint containing $IrCl_3$, but varying the number of applied coatings from 1 to 8. The heating after each coating, including the first one, was for 10 minutes at 500° C. The electrodes were then subjected to lifetime tests in a current reversal process as in Example I and the optimum lifetime of 1 month was achieved with the electrode coated four times. Again, this lifetime can be improved by increasing the final heating time.

EXAMPLE VI

A titanium coupon was degreased, rinsed in water, dried, etched and then surface treated as in Example I with a paint solution containing iridium and ruthenium chlorides in the weight ratio of 2:1 (as metal). The treatment was repeated four times until the titanium dioxide film formed contained a calculated amount of 0.2 $g/m^2$ Ir and 0.1 $g/m^2$ Ru, both calculated as metal. The heat treatment was carried out at 400° C., for 10 minutes after each applied coat and again 72 hours after the final coat.

The electrode was tested as an oxygen evolution anode in 1.5M sulphuric acid. The oxygen evolution half-cell potential was 1.6 V at a current density of 500 $A/m^2$ and 1.8 V at 2 $kA/m^2$, compared to 2.15 V and 2.35 V for a standard commercially available electrode having a coating of lead dioxide on titanium.

EXAMPLE VII

An electrode, prepared as in Example VI but surface treated at 480° C. with an iridium chloride paint to provide 0.3 $g/m^2$ (as metal) of iridium, was tested as oxygen-evolution anode for copper electrowinning in an electrolyte consisting of 150 g/l $H_2SO_4$ and 200 g/l $CuSO_4.5H_2O$ at 35° C. A copper cathode was used. The anode and cathode each had a surface area of 20 $cm^2$, and were spaced apart by 3 cm. The cell voltage varied from 1.5 V at a current density of 100 $A/m^2$ to 2.15 V at 1000 $A/m^2$. A pure cathodic copper deposit was obtained. The anode showed no sign of failure after operation at 500 $A/m^2$ for 6 months. During this period, the cathode was periodically removed to strip the copper deposit, while leaving the anode in the electrolyte. This periodic interruption of the current was found to have no adverse effect on the anode.

EXAMPLE VIII

Electrodes were prepared in a similar manner to Example I, but using a dilute paint containing chlorides of various platinum-group metals, including palladium, platinum and ruthenium, as well as rhodium and iridium as previously described. The electrodes containing Rh and/or Ir performed excellently when subjected to comparative lifetime tests as oxygen-evolution anodes. The other electrodes showed promise in other applications, notably Ru-containing electrodes for chloride electrolysis in non-oxygen evolving conditions.

EXAMPLE IX

A series of titanium electrodes measuring approximately $175\times50\times0.5$ mm were degreased, rinsed in water, dried, etched and then surface treated over both sides using the procedure of Example I to provide surface oxide films containing approximately 0.2 $g/m^2$ of Ru and 0.1 $g/m^2$ of Ir. These electrodes were mounted in spaced parallel relationship with a spacing of 2 mm in a rectangular tubular cell housing, and the terminal electrodes connected to form a bipolar cell. This cell was tested using dilute NaCl brine (1 g/l) containing calcium/magnesium hardness and, optionally, several ppm of manganese. It was found that the unwanted anodic/cathodic deposits did not adhere well to the electrode surface films and were easily removed by short periods of current reversal at appropriate intervals. The cell was typically operated at a current density of 500 $A/m^2$ to generate hypochlorite, and at 200 $A/m^2$ for deposit removal. The cell was also tested with intermittent operation without any adverse effect to the electrodes.

EXAMPLE X

Electrodes as in Example IX were immersed in contaminated seawater containing marine life and operated as anodes at a current density of 10 $A/m^2$ hours a day, Thls was found to keep them free from surface fouling, whereas unpolarized titanium in the same environment became completely covered with surface growths which reduced its efficiency as a heat exchange surface.

EXAMPLE XI

A degreased and cleaned titanium wire of 2.5 mm diameter is passed through rollers soaked with a solution made from 10 ml n-propanol, 0.5 ml HCl (concentrated) and 0.1 g of platinum and iridium chlorides, dried at 50° to 70° C. then at 120° C. and passed into an oven where it remains for 10 minutes at 500° C. in air. This procedure is repeated three more times to provide a surface oxide film containing approximately 0.2 $g/m^2$ of platinum and iridium. This corresponds to less than 2 mg of precious metal per meter of the wire. The treated wire is then loosely encased in a perforated flexible tube of inert plastics material of diameter about 5 mm. The encased wire is disposed about a metallic structure to be protected, this structure for example being immersed in seawater contaminated with several ppb of manganese. The wire is then connected as anode with the structure as cathode. Very large structures of complex shape can be effectively protected from corrosion in this way. Manganous deposits on the wire surface can be removed by very short periods of current reversal, e.g. for several minutes per week. If required, as a security measure parts of the surface-treated wire may be clad with metallic platinum at regular intervals (e.g. 1 cm per meter) or at selected strategic points.

EXAMPLE XII

Titanium powder (size 50–100 mesh ASTM) was degreased in 1:1 acetone/$CCl_4$ for 30 minutes, dried and then wetted with a solution of 6 ml ethanol, 0.4 ml HCl (concentrated, 12N) 0.2 g $IrCl_3$ and 0.1 g $RuCl_3$. 5 g of the degreased powder was mixed with 5 ml of the solution, the excess solution was drained off and the damp powder was slowly dried in air with a two stage drying, firstly at 50° to 70° C. for 15 minutes and then at 120° C. for 30 minutes. The dried powder was then heated at 500° C. in a closed furnace for 30 minutes to produce an activated surface film of titanium oxide containing the iridium/ruthenium electrocatalyst.

The activated titanium powder was then hammered into the surface of a lead sheet ($20\times15\times1.5$ mm) which had previously been degreased in 1:1 acetone/$CCl_4$ and etched in dilute nitric acid. The hammering was carried out with a pressure estimated at approximately 350 $kg/cm^2$, to partly embed and firmly anchor the activated titanium powder in the lead surface. Substantially the entire surface of the lead sheet was thus covered with the activated powder with a loading of approximately 120 g of the powder/$m^2$ of the surface, corresponding to a noble metal loading of 1.7 g Ir and 0.75 g Ru/$m^2$. Generally speaking, the loading of the activated powder will be between 30 and 200 $g/m^2$ of the sheet surface.

The resulting coated electrode and a corresponding uncoated lead sheet were tested as anodes in an electrolytic cell with a lead cathode and a 5% $H_2SO_4$ electrolyte at 20°–25° C. The measured oxygen overpotential of the coated anode according to the invention was significantly lower than that of the uncoated lead anode: 1480 mV (vs NHE) compared to 1680 mV at a current density of 500 $A/m^2$; and 1510 mV compared to 1830 mV at 1000 $A/m^2$. Furthermore, the coated electrode operated for one month at 2500 $A/m^2$ followed by one month at 1000 $A/m^2$ without exhibiting any notable increase in the oxygen overpotential whereas the uncoated lead anode failed (disintegrated) after only 4 days at 2500 $A/m^2$.

COMPARATIVE EXAMPLE XIII A

A titanium coupon was degreased, rinsed in water, dried and etched for ½ hour in a 10% aqueous solution of oxalic acid. A paint solution consisting of 0.5 g $IrCl_3.H_2O$, 3 ml isopropyl alcohol (IPA) and 0.2 ml HCl (concentrated) was then applied by brush to both sides of the coupon. The coupon was then dried and heated in air at 480° C. for ten minutes. The coating procedure was repeated twice, and the resulting coating had a loading of approximately 2.1 $g/m^2$ of iridium. The coating solution and procedure used are considered to be conventional. The resulting electrode was subjected to an accelerated lifetime test in 150 g/l sulphuric acid at a current density of 4.5 $kA/m^2$; its lifetime was 100 hours.

COMPARATIVE EXAMPLE XIII B

The procedure of Comparative Example XIII A was repeated using a paint solution consisting of 0.5 g $IrCl_3.H_2O$, 3 ml IPA and 1 ml HCl (concentrated), i.e. the same solution as before but with five times more HCl. The resulting electrode also had a loading of 2.1 $g/m^2$ of iridium. When subjected to the same accelerated lifetime test, the lifetime was 75 hours.

COMPARATIVE EXAMPLE XIII C

The procedure of Comparative Example XIII A was repeated using a paint solution consisting of 0.5 g $IrCl_3.H_2O$, 30 ml IPA and 0.2 ml HCl (concentrated), i.e. the same solution as in XIII A but with ten times more solvent, the twelve layers were applied with heating at 480° C. for seven minutes. The resulting electrode had a loading of 2.4 $g/m^2$ of iridium. When subjected to the same accelerated lifetime test, its lifetime was 71 hours.

EXAMPLE XIII

The procedure of Comparative Example XIII A was repeated but using a diluted paint solution in accordance with the invention consisting of 0.5 g $IrCl_3.H_2O$, 30 ml IPA and 2 ml HCl, i.e. with ten times as much solvent and ten times as much acid for the same precious metal loading. Sixteen layers were applied with heating at 480° C. for seven minutes, to give a catalyst loading of 2.0 $g/m^2$ of iridium. The lifetime of this electrode in identical conditions was 185 hours. This greatly increased lifetime is particularly surprising when considering that separate dilution of the acid (as in Comparative Example XIII B) and of the solvent (as in Comparative Example XIII C) leads to a reduction of lifetime.

This surprising increase of lifetime can be explained by the fact that no separate coating is formed. Instead, analysis of the surface showed that it consisted of a titanium dioxide grown up from the coupon surface incorporating iridium oxide as a mixed titanium-iridium oxide with a small percentage of iridium metal present. Thus all of the catalyst was incorporated fully in the surface oxide film without forming a separate coating as such.

With the Comparative Examples, analysis revealed that iridium oxide was present at the surface as a separate outer coating, as was to be expected. However, the test results show that this separate outer coating is much less stable than a corresponding amount of catalyst incorporated fully in the surface oxide film.

We claim:

1. In an electrode for use in electrocatalytic processes comprising a base of a film-forming metal with an operative electrocatalytic outer surface formed as an integral surface film of the film-forming metal base incorporating therein a platinum-group metal or compound thereof as electrocatalyst, the improvement comprising said electrocatalytic outer surface is formed by a surface treatment by applying to the surface of the film-forming metal base at least one layer of a solution of at least one thermodecomposable compound which consists essentially of a platinum-group metal compound, drying and heating each applied layer to decompose said compound in a similar manner to methods known per se for the formation of platinum-group metal and platinum-group metal oxide coatings, wherein said solution contains a halide agent which attacks the film-forming metal base and converts metal from the base into ions which are converted into a compound of the film-forming metal during the heating step, and wherein the concentration of said halide agent in the solution, the concentration of the platinum-group metal compound(s) in the solution, the drying, the heating and the number of applied layers are such that during the heating of each layer including the last layer, the electrocatalyst formed from the decomposed platinum-group metal compound is incorporated fully in a simultaneously-formed surface film of film-forming metal compound grown up from the base as a result of said halide agent attacking the film-forming metal base thereby forming an electrolytic outer surface, said outer surface being the surface film of film-forming metal compound integral with and wholly containing the electrocatalyst formed from the decomposed platinum-group metal compound.

2. The electrode of claim 1, wherein the surface film of the film-forming metal base consists of oxide.

3. The electrode of claim 1, wherein the surface film of the film-forming metal base consists of one of a carbide, nitride, hydride and boride.

4. The electrode of claim 1, 2 or 3, wherein the electrode base is sheet-like and the surface film contains up to 0.5 $g/m^2$, as metal, of the electrocatalyst per projected surface area of the electrode base.

5. The electrode of claim 1, 2 or 3, wherein said film contains at least one of iridium, rhodium and oxides or iridium and rhodium.

6. The electrode of claim 1, 2 or 3, wherein said film contains (a) at least one of iridium and rhodium and (b) ruthenium as metals or oxides in a metal weight ratio (a):(b) of from 4:1 to 1:4.

7. The electrode of claim 1, 2 or 3, wherein the electrode base is formed of particles.

8. In a method of forming an electrode for use in electrolytic processes comprising a base of film-forming metal with an operative electrocatalytic outer surface formed as an integral surface film of the film-forming metal base incorporating therein a platinum-group metal or compound thereof as electrocatalyst, the improvement comprising forming said electrocatalytic outer surface by a surface treatment by applying to the surface of the film-forming metal base at least one layer of a solution of at least one thermodecomposable compound which consists essentially of a platinum-group metal compound, drying and heating each applied layer to decompose said compound in a manner similar to methods known per se for the formation of platinum-group metal and platinum-metal oxide coatings, wherein said solution contains a halide agent which attacks the film-forming metal base and converts metal from the base into ions which are converted into a compound of the film-forming metal during the heating step, and wherein the concentration of said halide agent in the solution, the concentration of the platinum-group metal compound(s) in the solution, the drying, the heating and the number of applied layers are such that during the heating of each layer including the last layer, the electrocatalyst formed from the decomposed platinum-group metal compound is incorporated fully in a simultaneously-formed surface film of film-forming metal compound grown up from the base as a result of said halide agent attacking the film-forming metal base thereby forming an electrocatalytic outer surface, said outer surface being the surface film of film-forming metal compound integral with and wholly containing the electrocatalyst formed from the decomposed platinum-group metal compound.

9. The method of claim 8, wherein the electrode base is sheet-like and each applied layer of the solution contains up to 0.2 $g/m^2$ as metal of at least one of an iridium, rhodium and ruthenium compound per projected surface area of the electrode base.

10. The method of claim 8, wherein the solution contains compound of (a) at least one of iridium and rhodium and (b) ruthenium in a metal weight ratio (a):(b) of from 4:1 to 1:4.

11. The method of claim 9, wherein from 2 to 5 layers of the solution are applied, each followed by heating to between about 400° C. to 600° C. for about 5 to 15 minutes, the final layer possibly being heated for a longer period.

12. The method of claim 11, wherein the final surface film contains up to 0.5 $g/m^2$ as metal of the electrocatalyst per projected surface area of the electrode base.

13. The method of claim 8, wherein the solution contains said agent and said platinum-group metal compound in a molar ratio from 1:1 to 100:1.

14. The method of claim 13, wherein said molar ratio is selected between 3:1 and 30:1.

15. The method of claim 8, 9, 10, 11, 12, 13 or 14, wherein the heating is carried out in air to form a surface film of film-forming metal oxide.

16. The method of claim 8, 9, 10, 11, 12, 13 or 14, wherein the heating is carried out in one of a carbon, nitrogen, hydrogen and boron-containing non-oxidizing atmosphere to form a surface film selected from a film-forming metal carbide, nitride, hydride and boride.

17. In the production of an electrode for use in electrolytic processes, a method of activating the surface of a film-forming metal comprising applying to the surface of the film-forming metal at least one layer of a solution of at least one thermodecomposable compound which consists essentially of a platinum group metal compound, drying and heating each applied layer to decompose said compound, the improvement comprising said method is a surface treatment wherein a surface film of a compound of the film-forming metal which is electrocatalytic and electroconductive is formed by application of a solution containing a halide agent which attacks the film-forming metal surface and converts metal from the surface into ions which are converted into the compound of the film-forming metal during the heating step, wherein the concentration of said halide agent in the solution, the concentration of the platinum-group metal compound in the solution, the drying, the heating and the number of applied layers are such that during the heating of each layer including the last layer, the electrocatalyst formed from the decomposed platinum-group metal compound is incorporated fully in a simultaneously formed surface film of film-forming metal compound grown up from the film-forming metal as a result of said halide agent attacking the film-forming metal thereby forming an electrocatalytic outer surface, said outer surface being the surface film of film-forming metal compound integral with and wholly containing the electrocatalyst formed from the decomposed platinum-group metal compound.

18. The method of claim 17, wherein the film-forming metal is in particulate form.

19. The method of claim 18, wherein the drying step is carried out in at least two separate stages to drive off all solvent from the particulate film-forming metal.

20. The method of claim 18 or 19, wherein the heating is carried out in air to form a surface film of film-forming metal oxide on the particles.

21. The method of claim 18 or 19, wherein the heating is carried out in one of a carbon, nitrogen, hydrogen and boron-containing non-oxidizing atmosphere to form a surface film selected from a film-forming metal carbide, nitride, hydride and boride on the particles.

22. The method of claim 17, 18 or 19, wherein the solution contains compounds of (a) at least one of iridium and rhodium and (b) ruthenium in a metal weight ratio (a):(b) of from 4:1 to 1:4.

23. The method of claim 18 or 19, comprising the further step of applying the surface-activated particles onto a conductive support.

24. In an electrode for use in electrolytic processes comprising particles of film-forming metal having an electrocatalytic surface formed by applying to the film-forming metal particles at least one layer of a solution of at least one thermodecomposable compound which consists essentially of a platinum-group metal compound, drying and heating each applied layer to decompose said compound, the improvement comprising a surface film of a compound of the film-forming metal which is electrocatalytic and electroconductive is formed on the particles by a surface treatment by applying a solution containing a halide agent which attacks the film-forming metal surface of the particles and converts metal from the surface into ions which are converted into the compound of the film-forming metal during the heating step, and wherein the concentration of said agent in the solution, the concentration of the platinum-group metal compound(s) in the solution, the drying, the heating and the number of applied layers are such that during the heating of each layer including the last one, the electrocatalyst formed from the decomposed platinum group metal compound is incorporated fully in a simultaneously-formed surface film of film-forming metal compound grown up on the surface of the particles as a result of said halide agent attacking the film-forming metal particles thereby forming an electrocatalytic outer surface, said outer surface being the surface film of film-forming metal compound integral with and wholly containing the electrocatalyst formed from the decomposed platinum-group metal compound.

25. The electrode of claim 24, wherein the surface film of the film-forming metal particles consists of oxide.

26. The electrode of claim 24, wherein the surface film of the film-forming metal particles consists of one of a carbide, nitride, hydride and boride.

27. The electrode of claim 24, 25 or 26, wherein said surface film of the particles contains (a) at least one of iridium and rhodium and (b) ruthenium as metals or oxides in a metal weight ratio (a):(b) of from 4:1 to 1:4.

28. The electrode of claim 24, 25, or 26, wherein said particles are supported on a conductive support.

29. The electrode of claim 24, 25, or 26, wherein said particles are associated with a current feeder.

30. In an electrode for use in electrolytic processes comprising a base of film-forming metal with an operative electrocatalytic outer surface formed as an integral surface film of the film-forming metal base incorporating therein a platinum group metal or compound thereof as electrocatalyst, the improvement comprising said electrocatalytic outer surface is formed by a surface treatment by applying to the surface of the film-forming metal base at least one layer of a solution of at least one thermodecomposable compound which consists essentially of a platinum-group metal compound, drying and heating each applied layer to decompose said compound, wherein said solution contains a halide agent which attacks the film-forming metal base and converts metal from the base into ions which are converted into a film-forming metal compound during the heating step, and wherein the concentration of said halide agent in the solution and the concentration of said platinum-group metal compound in the solution and the drying and the heat procedure and the number of applied layers of the solution are such that during the heating of each layer, including the last layer, the electrocatalytic surface thus formed is an integral film of decomposed platinum-group metal compound and film-forming metal compound wherein the film-forming metal compound in the electrocatalytic surface is provided by a surface film grown up from the film-forming metal base as a result of said halide agent attacking the film-forming metal base and said decomposed platinum-group metal compound is fully incorporated in said surface film grown up from the film-forming metal base whereby the electrocatalytic material formed from the decomposed platinum-group metal compound is an integral part of said surface film.

* * * * *